US007023101B2

(12) United States Patent
Wang

(10) Patent No.: US 7,023,101 B2
(45) Date of Patent: Apr. 4, 2006

(54) AIR COOLING GENERATOR

(76) Inventor: Wen-Chang Wang, No. 666, Sec. 1, Chung Cheng Rd., Jen Te Hsiang, Tainan Hsien (TW)

( * ) Notice: Subject to any disclaimer, the term of this patent is extended or adjusted under 35 U.S.C. 154(b) by 148 days.

(21) Appl. No.: 10/813,544

(22) Filed: Mar. 29, 2004

(65) Prior Publication Data

US 2005/0212299 A1 Sep. 29, 2005

(51) Int. Cl.
*F01P 1/00* (2006.01)

(52) U.S. Cl. ..... 290/1 A; 290/1 B; 322/1; 123/2

(58) Field of Classification Search ..... 290/1 A, 290/1 B, 2; 322/1; 123/2, 3
See application file for complete search history.

(56) References Cited

U.S. PATENT DOCUMENTS 4,647,835 A * 3/1987 Fujikawa et al. ..... 322/1
4,835,405 A * 5/1989 Clancey et al. ..... 290/1 A
5,433,175 A * 7/1995 Hughes et al. ..... 123/2
5,515,816 A * 5/1996 Ball et al. ..... 123/41.7
5,899,174 A * 5/1999 Anderson et al. ..... 123/2
6,039,009 A * 3/2000 Hirose ..... 123/2
6,196,009 B1 * 3/2001 Nishi et al. ..... 62/155
6,230,667 B1 * 5/2001 Stauffer et al. ..... 123/2
6,492,740 B1 * 12/2002 Suzuki ..... 290/1 A
6,755,037 B1 * 6/2004 Engel et al. ..... 62/177
6,784,560 B1 * 8/2004 Sugimoto et al. ..... 290/1 R
6,952,056 B1 * 10/2005 Brandenburg et al. ..... 290/1 A

* cited by examiner

*Primary Examiner*—Nicholas Ponomarenko
(74) *Attorney, Agent, or Firm*—Alan D. Kamrath; Nikolai & Mersereau, P.A.

(57) ABSTRACT

A generator includes a housing, an engine, a first main impeller rotatably mounted in the engine, a first secondary impeller rotatably mounted in the housing and located outside of the engine, a generating body, a second main impeller rotatably mounted in the generating body, and a second secondary impeller rotatably mounted in the housing and located outside of the generating body. Thus, the first secondary impeller and the second secondary impeller can dissipate the heat produced from the engine and the generating body, thereby enhancing the heat dissipation effect of the generator, and thereby increasing the lifetime of the generator.

7 Claims, 3 Drawing Sheets

AIR COOLING GENERATOR

BACKGROUND OF THE INVENTION

1. Field of the Invention

The present invention relates to an air cooling cab-type generator, and more particularly to a generator having a greater heat dissipation effect.

2. Description of the Related Art

A conventional air cooling generator in accordance with the prior art shown in FIG. 3 comprises a housing 110, an engine 120 mounted in the housing 110, a first impeller 140 rotatably mounted in the engine 120, a generating body 130 mounted in the housing 110, a second impeller 150 rotatably mounted in the generating body 130, an oil tank 160 mounted in the housing 110, and an insulating layer 170 mounted on a periphery of the oil tank 160.

However, the engine 120 and the generating body 130 produce a larger heat during operation, so that it is necessary to provide a cooling fan located outside of the housing 110 to provide a heat dissipation effect. Thus, when the cooling fan is inoperative or worn out during a long-term utilization, the engine 120 continues to operate, so that the temperature in the housing 110 is increased gradually and excessively, thereby easily causing danger to a user.

SUMMARY OF THE INVENTION

The primary objective of the present invention is to provide a generator having a greater heat dissipation effect and producing smaller noise.

Another objective of the present invention is to provide a generator, wherein the first secondary impeller and the second secondary impeller can assist the first main impeller and the second main impeller to introduce the ambient air into the housing and drain the hot air outward from the housing smoothly.

A further objective of the present invention is to provide a generator, wherein the first secondary impeller and the second secondary impeller can dissipate the heat produced from the engine and the generating body, thereby enhancing the heat dissipation effect of the generator, and thereby increasing the lifetime of the generator.

A further objective of the present invention is to provide a generator, wherein the first secondary impeller and the second secondary impeller produce a wind shear to isolate the noise produced from the engine during operation, thereby reducing the noise.

A further objective of the present invention is to provide a generator, wherein the generating body has a greater heat dissipation effect, thereby reducing the heat loss and increasing the output power of the generating body.

A further objective of the present invention is to provide a generator, wherein the first secondary impeller is operated with the engine synchronously, and the second secondary impeller is operated with the generating body synchronously, without having to provide a heat draining equipment, such as a cooling fan, thereby decreasing costs of the generator.

In accordance with the present invention, there is provided a generator, comprising:

a housing;

an engine mounted in the housing;

a first main impeller rotatably mounted in the engine;

a first secondary impeller rotatably mounted in the housing and located outside of the engine;

a generating body mounted in the housing and connected to the engine;

a second main impeller rotatably mounted in the generating body; and a second secondary impeller rotatably mounted in the housing and located outside of the generating body.

Further benefits and advantages of the present invention will become apparent after a careful reading of the detailed description with appropriate reference to the accompanying drawings.

DETAILED DESCRIPTION OF THE INVENTION

Figure 1:
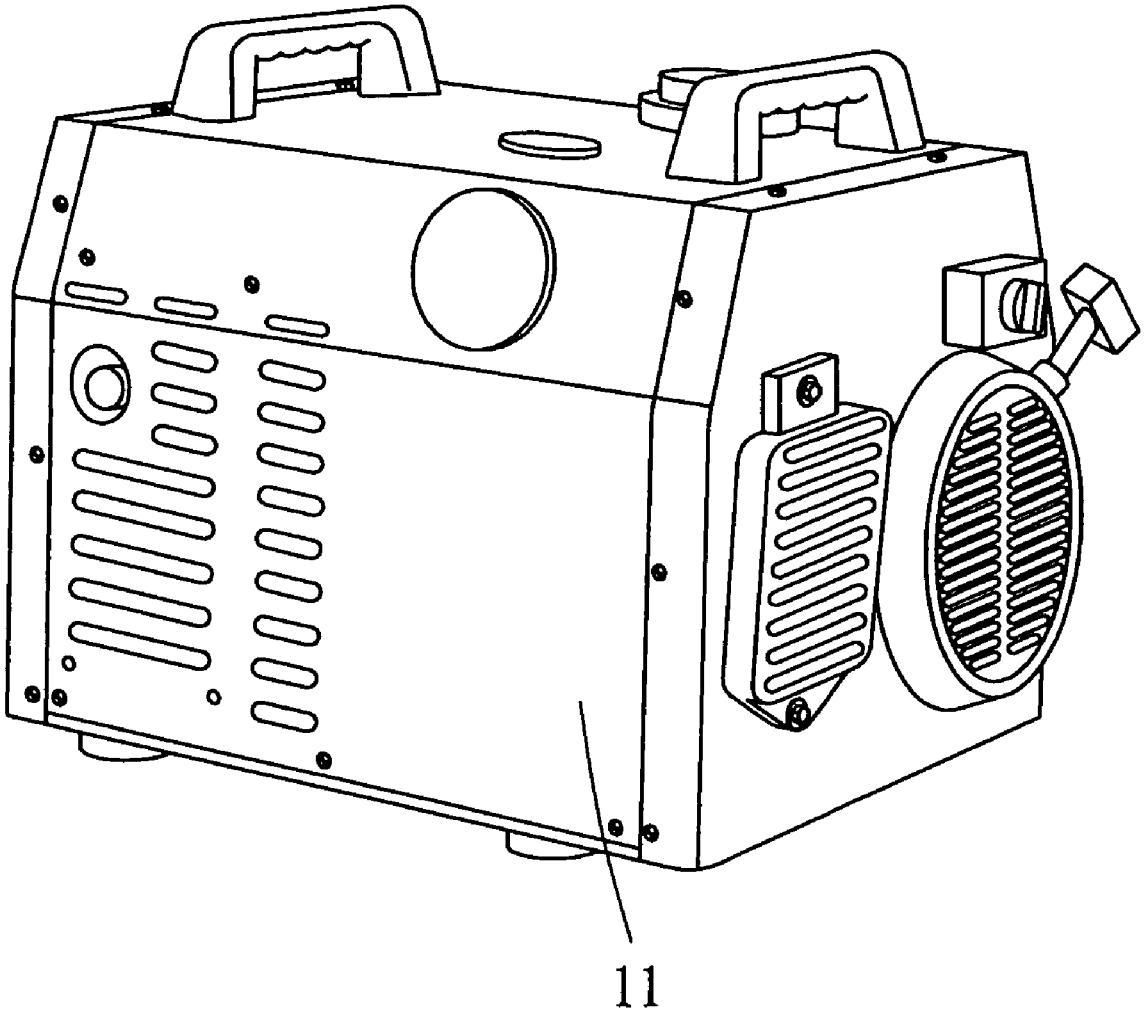
FIG. 1 is a perspective view of a generator in accordance with the preferred embodiment of the present invention.
Figure 2:
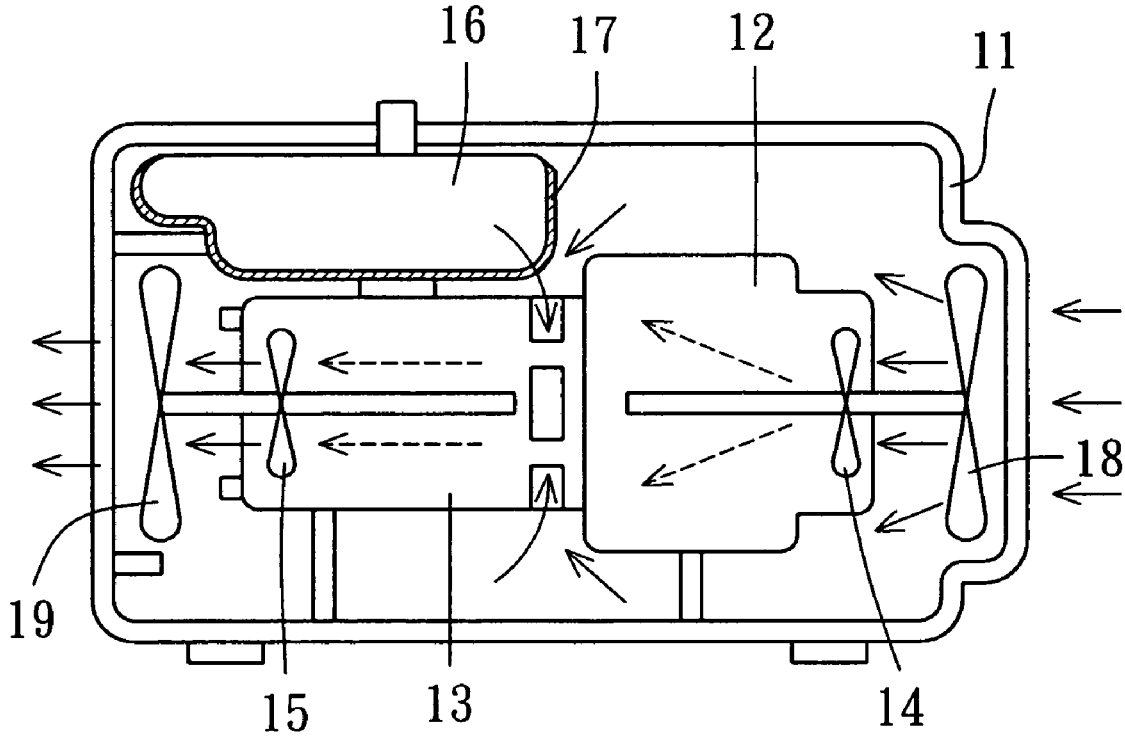
FIG. 2 is a plan cross-sectional view of the generator as shown in FIG. 1.
Figure 3:
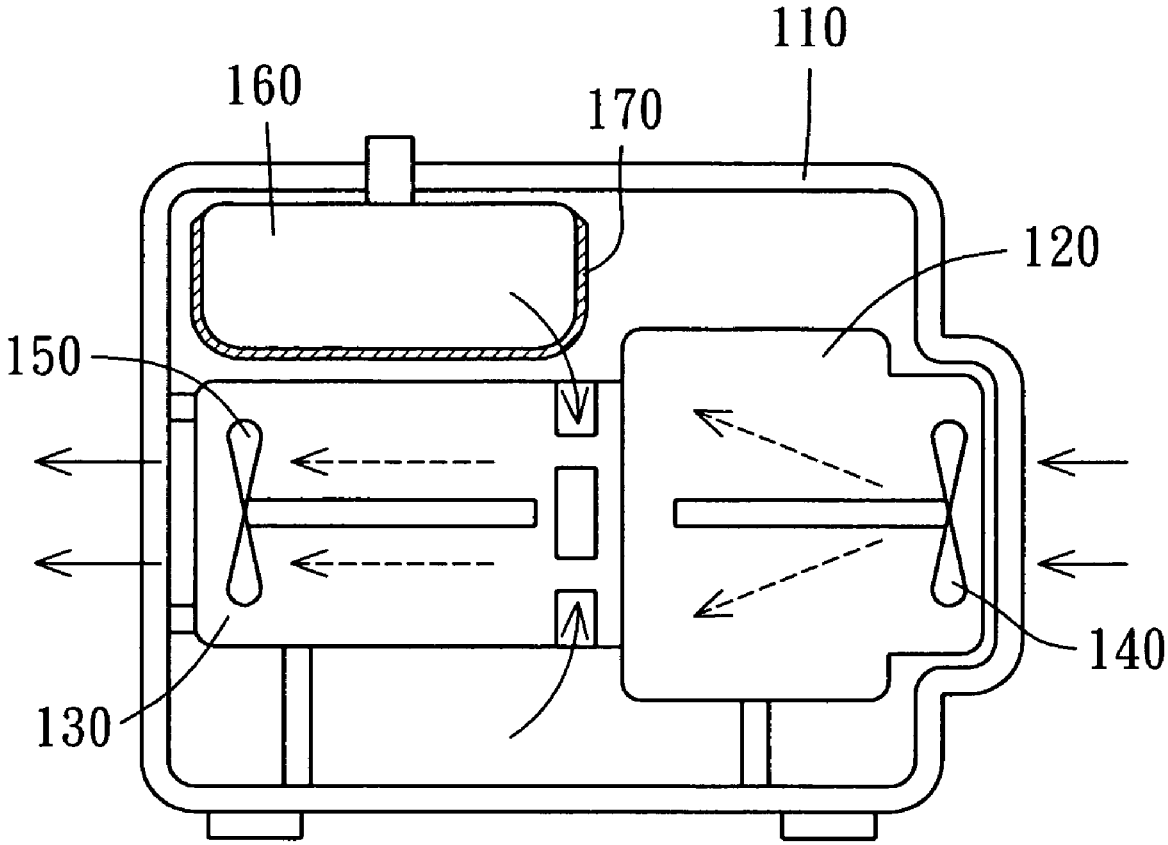
FIG. 3 (PRIOR ART)
FIG. 3 is a plan cross-sectional view of a conventional generator in accordance with the prior art.

Referring to FIGS. 1 and 2, an air cooling generator in accordance with the preferred embodiment of the present invention comprises a housing 11, an engine 12 mounted in the housing 11, a first main impeller 14 rotatably mounted in the engine 12, a first secondary impeller 18 rotatably mounted in the housing 11 and located outside of the engine 12, a generating body 13 mounted in the housing 11 and connected to the engine 12, a second main impeller 15 rotatably mounted in the generating body 13, a second secondary impeller 19 rotatably mounted in the housing 11 and located outside of the generating body 13, an oil tank 16 mounted in the housing 11, and an insulating layer 17 mounted on a periphery of the oil tank 16.

Preferably, the first secondary impeller 18 is co-axial with the first main impeller 14 and has a size greater than that of the first main impeller 14, and the second secondary impeller 19 is co-axial with the second main impeller 15 and has a size greater than that of the second main impeller 15. In addition, the first secondary impeller 18 is operated with the engine 12 synchronously, and the second secondary impeller 19 is operated with the generating body 13 synchronously.

In practice, as shown in FIG. 2, the first secondary impeller 18 and the second secondary impeller 19 can assist the first main impeller 14 and the second main impeller 15 to introduce the ambient air into the housing 11 and drain the hot air outward from the housing 11 smoothly. In addition, the first secondary impeller 18 and the second secondary impeller 19 can dissipate the heat produced from the engine 12 and the generating body 13 as indicated by the arrows shown in FIG. 2, thereby enhancing the heat dissipation effect of the generator, and thereby increasing the lifetime of the generator. Further, the first secondary impeller 18 and the second secondary impeller 19 produce a wind shear to isolate the noise produced from the engine 12 during operation, thereby reducing the noise. Further, the generating body 13 has a greater heat dissipation effect, thereby reducing the heat loss and increasing the output power of the generating body 13. Further, the first secondary impeller 18 is operated with the engine 12 synchronously, and the second secondary impeller 19 is operated with the generating body 13 synchronously, without having to provide an additional heat draining equipment, such as a cooling fan, thereby decreasing costs of the generator.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A generator, comprising:

a housing;

an engine mounted in the housing;

a first main impeller rotatably mounted in the engine;

a first secondary impeller rotatably mounted in the housing and located outside of the engine;

a generating body mounted in the housing and connected to the engine;

a second main impeller rotatably mounted in the generating body; and a second secondary impeller rotatably mounted in the housing and located outside of the generating body.

2. The generator in accordance with claim 1, wherein the first secondary impeller is co-axial with the first main impeller.

3. The generator in accordance with claim 1, wherein the first secondary impeller has a size greater than that of the first main impeller.

4. The generator in accordance with claim 1, wherein the second secondary impeller is co-axial with the second main impeller.

5. The generator in accordance with claim 1, wherein the second secondary impeller has a size greater than that of the second main impeller.

6. The generator in accordance with claim 1, wherein the first secondary impeller is operated with the engine synchronously.

7. The generator in accordance with claim 1, wherein the second secondary impeller is operated with the generating body synchronously.

* * * * *